US008568174B2

(12) United States Patent
Liu

(10) Patent No.: US 8,568,174 B2
(45) Date of Patent: Oct. 29, 2013

(54) CARD CONNECTOR

(75) Inventor: Zhu-Rui Liu, Guang-Dong (CN)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/405,231

(22) Filed: Feb. 24, 2012

(65) Prior Publication Data

US 2013/0225003 A1 Aug. 29, 2013

(51) Int. Cl.
*H01R 24/00* (2011.01)

(52) U.S. Cl.
USPC ..... 439/630

(58) Field of Classification Search
USPC ..... 439/630, 188, 159, 540.1
See application file for complete search history.

(56) References Cited

U.S. PATENT DOCUMENTS 6,056,601 A * 5/2000 Pollock et al. ..... 439/630
7,238,051 B2 * 7/2007 Miyawaki et al. ..... 439/630
7,556,534 B1 * 7/2009 Ho ..... 439/630
8,038,477 B2 * 10/2011 Zhang ..... 439/630
8,337,252 B2 * 12/2012 Mambakkam et al. ..... 439/630

* cited by examiner

*Primary Examiner* — Phuong Dinh
(74) *Attorney, Agent, or Firm* — Cheng-Ju Chiang

(57) ABSTRACT

A card connector for receiving a micro-SIM card and a micro-SD card therein includes an insulating housing, a plurality of signal terminals and conductive terminals, and a supporting tray. The insulating housing defines an accommodating chamber. The signal terminals are disposed in the insulating housing with contact portions thereof projecting into the accommodating chamber. The conductive terminals are disposed in the insulating housing with touching portions thereof projecting into the accommodating chamber. The supporting tray defines a first receiving space and a second receiving space for receiving the micro-SIM card and the micro-SD card therein respectively. The supporting tray together with the micro-SIM card and the micro-SD card is inserted into the accommodating chamber. Bottoms of the first receiving space and second receiving space are opened freely to make the micro-SIM card electrically contact with the contact portions and the micro-SD card electrically contact with the touching portions.

5 Claims, 5 Drawing Sheets

CARD CONNECTOR

BACKGROUND OF THE INVENTION

1. Field of the Invention

The present invention generally relates to a card connector, and more particularly to a card connector capable of receiving a micro-SIM (Subscriber Identity Module) card and a micro-SD (Secure Digital) card therein simultaneously.

2. The Related Art

A conventional card connector adapted for receiving a micro-SIM card and a micro-SD card therein includes an insulating housing, a plurality of first terminals and second terminals. The insulating housing defines a first accommodating chamber and a second accommodating chamber. The insulating housing further defines a plurality of first terminal grooves communicating with the first accommodating chamber, and a plurality of second terminal grooves communicating with the second accommodating chamber. The first terminals are disposed in the first terminal grooves and further project into the first accommodating chamber. The second terminals are disposed in the second terminal grooves and further project into the second accommodating chamber. When the card connector is in use, the micro-SIM card and the micro-SD card should be inserted into the first accommodating chamber and the second accommodating chamber in sequence that results in an inconvenient insertion of the micro-SIM card and the micro-SD card into the card connector.

SUMMARY OF THE INVENTION

An object of the present invention is to provide a card connector adapted for receiving a micro-SIM card and a micro-SD card therein includes an insulating housing, a plurality of signal terminals, a plurality of conductive terminals and a supporting tray. The insulating housing has a base board, a first side wall and a second side wall protruding upward from two opposite sides of the base board, and a rear wall connecting with rear ends of the first side wall and the second side wall. An accommodating chamber is formed among the base board, the first side wall, the second side wall and the rear wall. One side of the base board defines two rows of openings communicating with one side of the accommodating chamber. A rear of the other side of the base board defines a window communicating with the other side of the accommodating chamber. The signal terminals are disposed in the insulating housing with contact portions thereof projecting into the one side of the accommodating chamber through the openings respectively. The conductive terminals are disposed in the insulating housing with touching portions thereof projecting into the other side of the accommodating chamber through the window. The supporting tray defines a first receiving space and a second receiving space with front ends thereof being opened freely for receiving the micro-SIM card and the micro-SD card therein, respectively. The supporting tray together with the micro-SIM card and the micro-SD card is inserted into the accommodating chamber of the insulating housing. Bottoms of the first receiving space and the second receiving space are further opened freely to make the micro-SIM card electrically contact with the contact portions of the signal terminals and the micro-SD card electrically contact with the touching portions of the conductive terminals.

As described above, the supporting tray together with the micro-SIM card and the micro-SD card is inserted in the accommodating chamber of the insulating housing to make the micro-SIM card and the micro-SD card insert in the card connector simultaneously so as to facilitate the micro-SIM card and the micro-SD card for being assembled in the card connector. Furthermore, the first receiving space and the second receiving space of the supporting tray for receiving the micro-SIM card and the micro-SD card respectively are disposed side by side to lower a thickness of the card connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
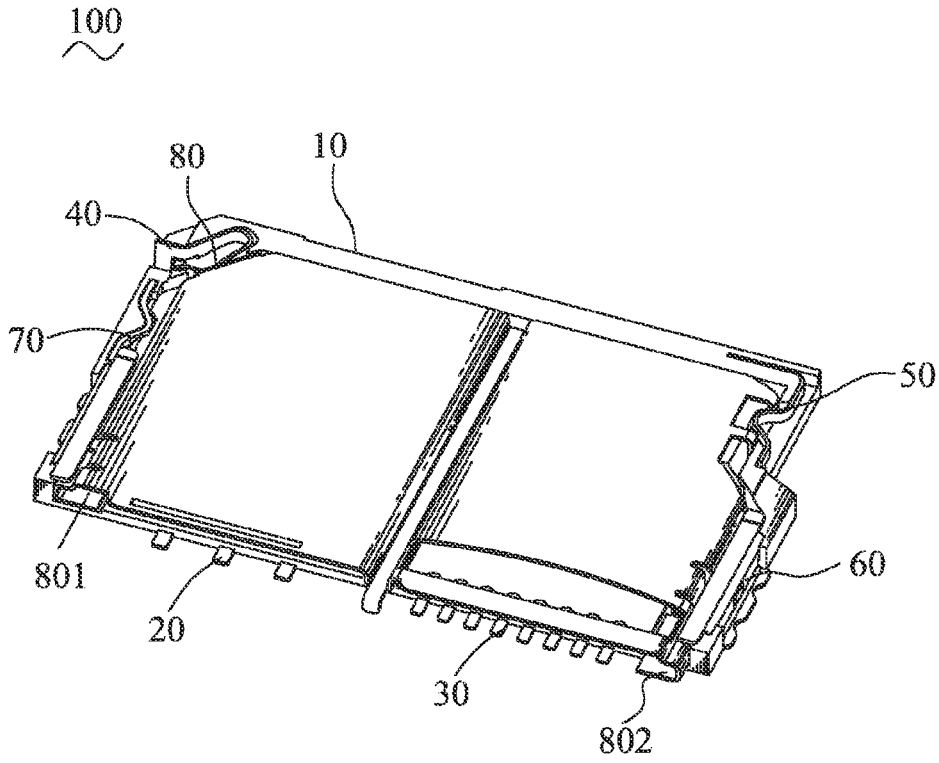
FIG. 1 is a perspective view of a card connector in accordance with the present invention.
Figure 2:
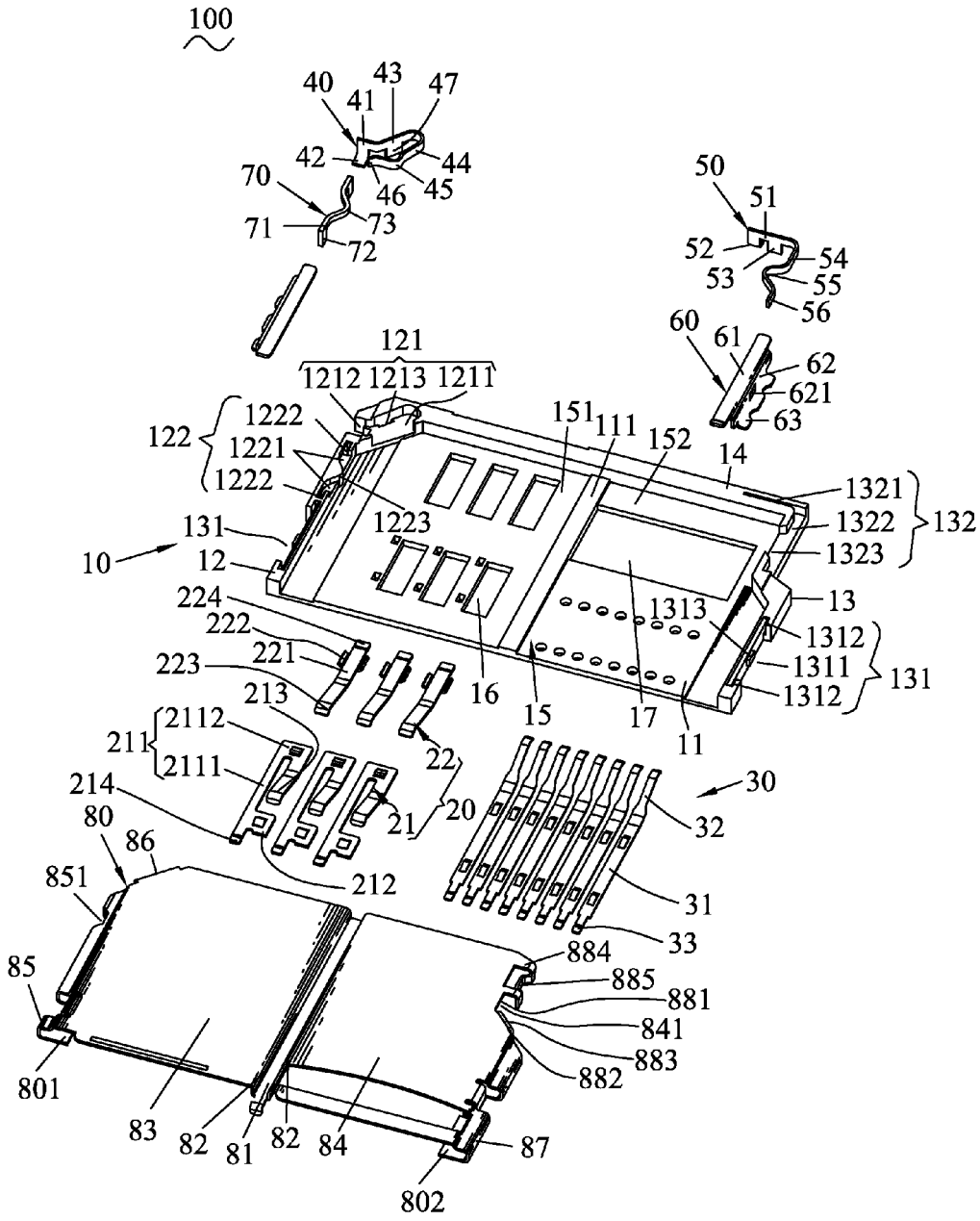
FIG. 2 is an exploded view of the card connector of FIG. 1.
Figure 3:
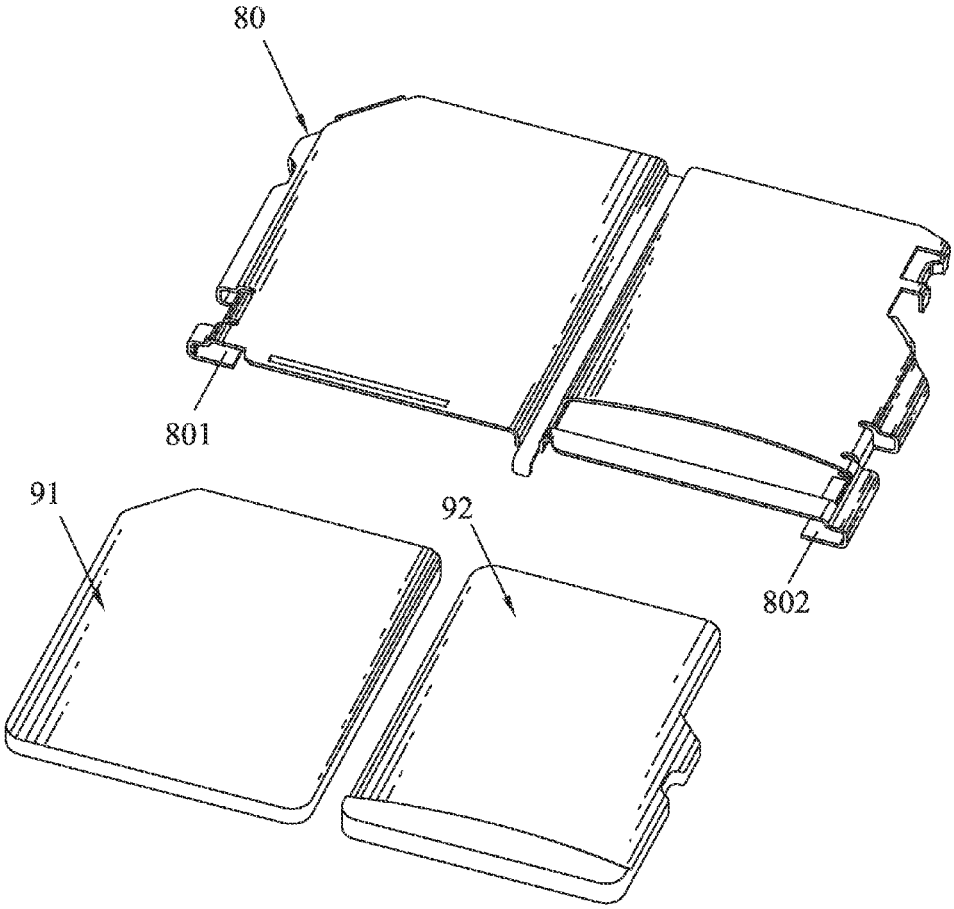
FIG. 3 is a perspective view of a micro-SIM card, a micro-SD card and a supporting tray of the card connector of FIG. 1, wherein the micro-SIM card, the micro-SD card and the supporting tray are apart from one another.

With reference to FIGS. 1-3, a card connector 100 in accordance with the present invention is shown. The card connector 100 adapted for receiving a micro-SIM card 91 and a micro-SD card 92 therein includes an insulating housing 10, a plurality of signal terminals 20, a plurality of conductive terminals 30, a first switch terminal 40, a second switch terminal 50, two fastening elements 60, a limiting element 70 and a supporting tray 80.

Figure 4:
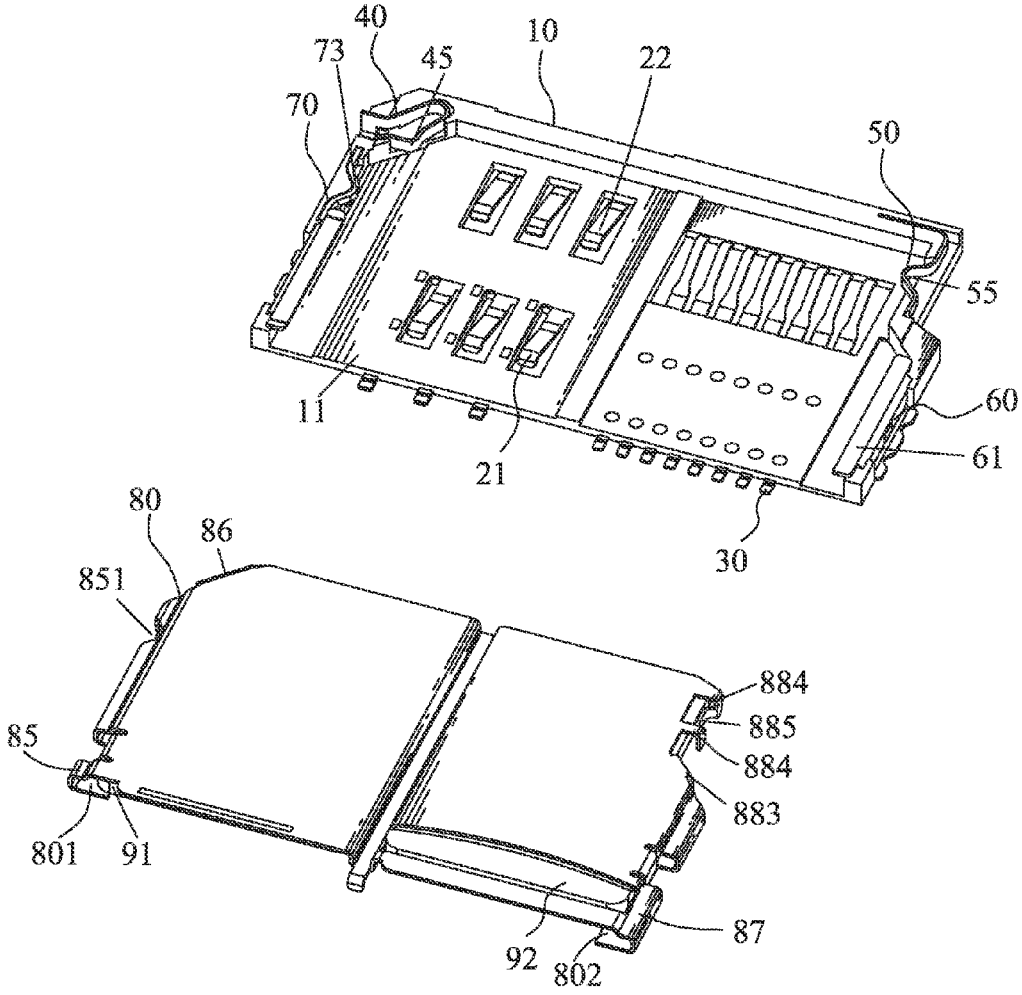
FIG. 4 is a partially exploded view of the card connector of FIG. 1, wherein the supporting tray together with the micro-SIM card and the micro-SD card is disassembled from the card connector.
Figure 5:
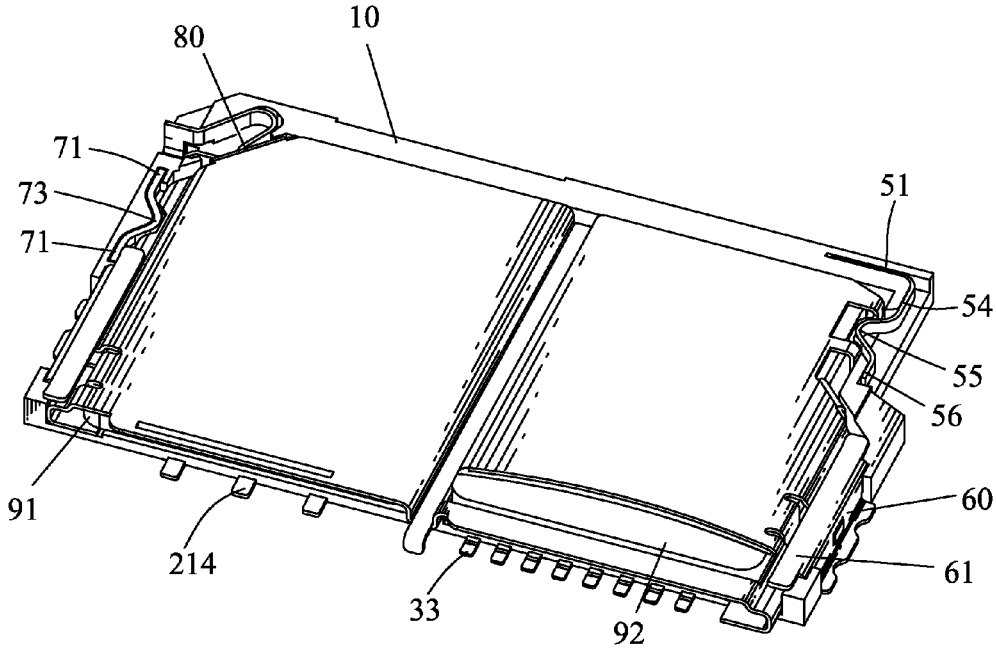
FIG. 5 is an assembling view of the card connector of FIG. 1, and the micro-SIM card and the micro-SD card.
Figure 6:
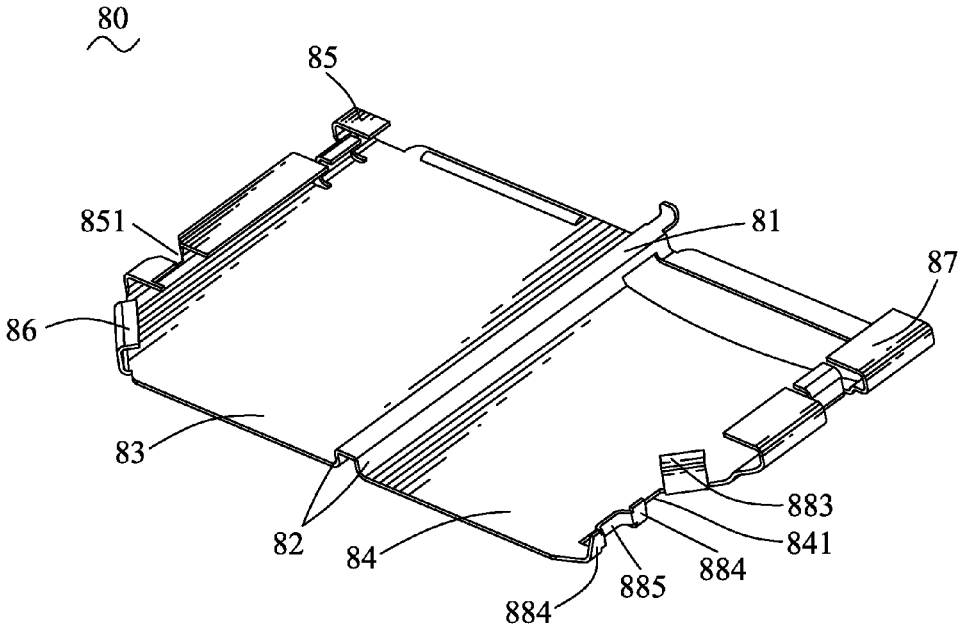
FIG. 6 is a perspective view of the supporting tray of the card connector of FIG. 2.

Referring to FIG. 2 and FIG. 4, the insulating housing 10 has a base board 11 of a substantial rectangular shape, a first side wall 12 and a second side wall 13 protruding upward from two opposite sides of the base board 11, and a rear wall 14 protruding upward from a rear of the base board 11 and connecting with rear ends of the first side wall 12 and the second side wall 13. An accommodating chamber 15 is formed among the base board 11, the first side wall 12, the second side wall 13 and the rear wall 14. A separating block 111 protrudes upward and extends longitudinally from a substantial middle of the base board 11 to divide the accommodating chamber 15 into a first accommodating chamber 151 and a second accommodating chamber 152. One side of the base board 11 defines two rows of openings 16 located at a front thereof and at a rear thereof respectively, and communicating with the first accommodating chamber 151. Each row of the openings 16 is arranged along a transverse direction. A rear of the other side of the base board 11 defines a window 17 communicating with the second accommodating chamber 152.

A corner between the first side wall 12 and the rear wall 14 defines a first switch terminal groove 121 which includes a receiving groove 1211 concaved downward in a top of the corner between the first side wall 12 and the rear wall 14 and communicating with the first accommodating chamber 151, a notch 1212 being cut off in one side of a bottom sidewall of the receiving groove 1211 adjacent to the first side wall 12 and passing through the first side wall 12, and an insertion slot 1213 penetrating through an innermost side of the bottom sidewall of the receiving groove 1211. The first side wall 12 defines a limiting terminal groove 122 which includes two holding grooves 1221 concaved downward in two portions of a top of the first side wall 12, and two fastening slots 1222 extending oppositely from two opposite sides of the two holding grooves 1221. An arc-shaped protrusion 1223 is protruded into the first accommodating chamber 151 from an inner side surface of the first side wall 12 and located between the two holding grooves 1221. A bottom of each fastening slot 1222 extends downward to form a fastening fillister (not shown).

The first side wall 12 and the second side wall 13 respectively defines a fastening groove 131 which includes a passage 1311 extending vertically to penetrate through an outside of a front of the first side wall 12 or the second side wall 13, and two clipping slots 1312 extending oppositely from two opposite sides of the passage 1311. A buckling portion 1313 is protruded outward from an innermost sidewall of each passage 1311. The insulating housing 10 defines a second switch terminal groove 132 which includes a fastening slit 1321 opened in a top of one end of the rear wall 14 adjacent to the second side wall 13, an accommodating groove 1322 opened in an outer side of a rear of the second side wall 13 and a connecting groove 1323 connecting with a middle of an inner side of the accommodating groove 1322. A bottom of the rear wall 14 defines an inserting slot (not shown) communicating with a middle of a bottom of the fastening slit 1321.

Referring to FIG. 2, the signal terminals 20 include a plurality of first signal terminals 21 and a plurality of second signal terminals 22. Each of the first signal terminals 21 has an inverted L-shaped first fastening portion 211 from a top view. The fastening portion 211 has a first arm 2111 disposed longitudinally, and a second arm 2112 perpendicular to the first arm 2111. A front of one side of the first arm 2111 extends sideward to form a second fastening portion 212 located at a same side as that of the second arm 2112. One side of the second arm 2112 is inclined upward and forward, and then arched upward to form a first contact portion 213. A front end of the first arm 2111 is inclined downward and forward, and then extends forward to form a first soldering portion 214. Each of the second signal terminals 22 has a third fastening portion 221. Two middles of two opposite sides of the third fastening portion 221 are inclined upward and sideward to form two enforcing portions 222. A front end of the third fastening portion 221 is inclined upward and forward and then arched upward to form a second contact portion 223. A rear end of the third fastening portion 221 is inclined downward and rearward, and then extends rearward to form a second soldering portion 224.

Referring to FIG. 2, each of the conductive terminals 30 has an elongated locating portion 31. A rear end of the locating portion 31 is inclined upward and rearward, and then is arched upward to form a touching portion 32. A middle of a front end of the locating portion 31 extends forward, then is inclined downward and forward and further extends forward to form a soldering foot 33.

Referring to FIG. 2, the first switch terminal 40 has a first base arm 41 disposed vertically. One side of a bottom of the first base arm 41 is bent forward to form a first soldering arm 42. One end of the first base arm 41 away from the first soldering arm 42 is smoothly inclined rearward and sideward to form a first fastening arm 43. A middle of a bottom of the first fastening arm 43 protrudes downward to form an insertion arm 47. An obtuse angle is shown between the first fastening arm 43 and the first base arm 41. A free end of the first fastening arm 43 is bent sideward and then slantwise extends forward to form a first elastic arm 44 away from the first base arm 41. A free end of the first elastic arm 44 is arched outward to form a first touching arm 45. A free end of the first touching arm 45 extends along a same extending direction as that of the free end of the first elastic arm 44 to form a first restraining arm 46.

Referring to FIG. 2, the second switch terminal 50 has an elongated second base arm 51. One end of a bottom of the second base arm 51 protrudes downward and bends rearward to form a second soldering arm 52. A middle of the bottom of the second base arm 51 protrudes downward to form a second fastening arm 53. One end of the second base arm 51 away from the second soldering arm 52 bends forward to form a second elastic arm 54. A free end of the second elastic arm 54 is arched sideward to form a second touching arm 55 located in front of the second base arm 51. A free end of the second touching arm 55 extends forward to form a second restraining arm 56.

Referring to FIG. 2, each of the fastening elements 60 has an elongated pressing plate 61 at a top thereof. A middle of one side of the pressing plate 61 bends downward to form a T-shaped connecting plate 62 from a side view. The connecting plate 62 defines a buckling hole 621. A bottom of the connecting plate 62 bends opposite to the pressing plate 61 to form a soldering plate 63. The limiting element 70 has an arc-shaped resisting portion 73. Two opposite ends of the resisting portion 73 extend oppositely to form two fastening strips 71. Two bottoms of the two fastening strips 71 extend downward to form two insertion strips 72.

Referring to FIG. 2 again, the supporting tray 80 has an elongated base plate 81. Two opposite sides of the base plate 81 bend upward to form two elongated lateral plates 82. Two tops of the two lateral plates 82 extend oppositely to form a first top plate 83 and a second top plate 84. A plurality of first clamping plates 85 of substantial U-shaped from a front view is connected with a free side edge of the first top plate 83 with the mouths thereof facing the corresponding lateral plate 82 at a distance. A notch 851 is formed between two of the first clamping plates 85 and located at a rear of the first top plate 83. A free corner at the rear of the first top plate 83 is bent downward, and then bent inward to form a blocking tail 86. A first receiving space 801 is formed among the first top plate 83, the corresponding lateral plate 82, the first clamping plates 85 and the blocking tail 86.

A plurality of second clamping plates 87 of substantial U-shaped from the front view is connected with a free side edge of the second top plate 84 with the mouths thereof facing the corresponding lateral plate 82 at a distance. A rear of the free side of the second top plate 84 is cut off to define a right-angle trapezoid gap 841 passing through the rear end of the free side of the second top plate 84. The gap 841 has a straight sidewall 881 substantially extending longitudinally, and a tilted sidewall 882 connecting between a front end of the straight sidewall 881 and the free side edge of the second top plate 84. The tilted sidewall 882 of the gap 841 extends downward, and then bends inward to form a blocking plate 883. Two portions of the straight sidewall 881 protrude outward and then bend downward to form two propping arms 884. Two free ends of the two propping arms 884 are inclined towards each other and then extend towards each other to form a resisting arm 885. A second receiving space 802 is formed among the second top plate 84, the corresponding lateral plate 82, the second clamping plates 87, the blocking plate 883, the propping arms 884 and the resisting arm 885. The second receiving space 802 and the first receiving space 801 are disposed side by side.

Referring to FIG. 1, FIG. 2, FIG. 4 and FIG. 6, in assembly, the signal terminals 20 and the conductive terminals 30 are molded integrally with the insulating housing 10. Specifically, the first fastening portions 211 and the second fastening portions 212 of the first signal terminals 21 are molded in the bottom wall of the first accommodating chamber 151. The first contact portions 213 of the first signal terminals 21 project into the first accommodating chamber 151 through the openings 16 at the front of the bottom wall of the first accommodating chamber 151. The first soldering portions 214 of the first signal terminals 21 project out of the bottom wall of the first accommodating chamber 151 from a front end of the bottom wall of the first accommodating chamber 151. The third fastening portions 221 and the enforcing portions 222 of the second signal terminals 22 are molded in the bottom wall of the first accommodating chamber 151. The second contact portions 223 of the second signal terminals 22 project into the first accommodating chamber 151 through the openings 16 at the rear of the bottom wall of the first accommodating chamber 151. The second soldering portions 224 of the second signal terminals 22 project out of the bottom wall of the first accommodating chamber 151 from a rear end of the bottom wall of the first accommodating chamber 151. The locating portions 31 of the conductive terminals 30 are molded in the bottom wall of the second accommodating chamber 152. The touching portions 32 of the conductive terminals 30 project into the second accommodating chamber 152 through the window 17. The soldering feet 33 of the conductive terminals 30 project out of the bottom wall of the second accommodating chamber 152 through a front end of the bottom wall of the second accommodating chamber 152.

The first switch terminal 40 is disposed in the first switch terminal groove 121. The first fastening arm 43, the first elastic arm 44 and the first restraining arm 46 are received in the receiving groove 1211. The first base arm 41 and the first soldering arm 42 are disposed in the notch 1212. The insertion arm 47 is inserted into the insertion slot 1213. The first touching arm 45 projects into the first accommodating chamber 151. The second switch terminal 50 is disposed in the second switch terminal groove 132. The second base arm 51 is fastened in the fastening slit 1321. The second soldering arm 52 projects out of the insulating housing 10 through a rear of the rear wall 14. The second fastening arm 53 is inserted into the inserting slot. The second elastic arm 54 and the second restraining arm 56 are disposed in the accommodating groove 1322. The second touching arm 55 projects into the second accommodating chamber 152 through the connecting groove 1323. Two opposite sides of each connecting plate 62 are clipped in the clipping slots 1312. Middles of the connecting plates 62 of the fastening elements 60 are located in the passage 1311 with the buckling portion 1313 being buckled in the buckling hole 621. The pressing plates 61 of the two fastening elements 60 project into the accommodating chamber 15 of the insulating housing 10 and are respectively propped up by tops of insides of the first side wall 12 and the second side wall 13. The soldering plates 63 of the fastening elements 60 project out of the first side wall 12 and the second side wall 13 from the passages 1311 respectively. The limiting element 70 is disposed in the limiting terminal groove 122. The fastening strips 71 are fastened in the fastening slots 1222. The insertion strips 72 are inserted into the fastening fillisters. The protrusion 1223 resists against the resisting portion 73 to make the resisting portion 73 project into the first accommodating chamber 151 of the accommodating chamber 15.

Referring to FIGS. 1-6, in use, the micro-SIM card 91 is inserted into the first receiving space 801 of the supporting tray 80 and the micro-SD card 92 is inserted into the second receiving space 802 of the supporting tray 80 to dispose the micro-SIM card 91 and the micro-SD card 92 in the supporting tray 80 side by side. Then the supporting tray 80 together with the micro-SIM card 91 and the micro-SD card 92 is inserted in the accommodating chamber 15 of the insulating housing 10 to make the micro-SIM card 91 located in the first accommodating chamber 151 and the micro-SD card 92 located in the second accommodating chamber 152. The base plate 81 is located on the separating block 111. The pressing plates 61 of the fastening elements 60 press on the first clamping plates 85 and the second clamping plates 87 of the supporting tray 80 to restrain the supporting tray 80 in the accommodating chamber 15. The resisting portion 73 of the limiting element 70 is buckled in the notch 851 of the supporting tray 80 to prevent the supporting tray 80 receding from the accommodating chamber 15 of the insulating housing 10. A middle part of the resisting arm 885 is flat arched inward to restrict the micro-SD card 92 in the second receiving space 802. At this moment, the supporting tray 80 together with the micro-SIM card 91 and the micro-SD card 92 is fully inserted into the accommodating chamber 15 of the insulating housing 10. Bottoms of the first receiving space 801 and the second receiving space 802 are further opened freely to make the micro-SIM card 91 electrically contact with first contact portions 213 of the first signal terminals 21 and the second contact portions 223 of the second signal terminals 22, and the micro-SD card 92 electrically contact with the touching portions 32 of the conductive terminals 30. The first touching arm 45 of the first switch terminal 40 resists against the blocking tail 86 of the supporting tray 80, and the second touching arm 55 of the second switch terminal 50 resists against the resisting arm 885 of the supporting tray 80. The second touching arm 55 of the second switch terminal 50 is blocked between the two propping arms 884 to prevent the supporting tray 80 receding from the accommodating chamber 15 of the insulating housing 10.

As described above, the supporting tray 80 together with the micro-SIM card 91 and the micro-SD card 92 is inserted in the accommodating chamber 15 of the insulating housing 10 to make the micro-SIM card 91 and the micro-SD card 92 insert in the card connector 100 simultaneously so as to facilitate the micro-SIM card 91 and the micro-SD card 92 for being assembled in the card connector 100. Furthermore, the first receiving space 801 and the second receiving space 802 of the supporting tray 80 for receiving the micro-SIM card 91 and the micro-SD card 92 respectively are disposed side by side to lower a thickness of the card connector 100.

What is claimed is:

1. A card connector adapted for receiving a micro-SIM (Subscriber Identity Module) card and a micro-SD (Secure Digital) card therein, comprising:

an insulating housing having a base board, a first side wall and a second side wall protruding upward from two opposite sides of the base board, and a rear wall connecting with rear ends of the first side wall and the second side wall, an accommodating chamber being formed among the base board, the first side wall, the second side wall and the rear wall, one side of the base board defining two rows of openings communicating with one side of the accommodating chamber, a rear of the other side of the base board defining a window communicating with the other side of the accommodating chamber;

a plurality of signal terminals disposed in the insulating housing with contact portions thereof projecting into the one side of the accommodating chamber through the openings respectively;

a plurality of conductive terminals disposed in the insulating housing with touching portions thereof projecting into the other side of the accommodating chamber through the window; and a supporting tray defining a first receiving space and a second receiving space with front ends thereof being opened freely for receiving the micro-SIM card and the micro-SD card therein, respectively, the supporting tray together with the micro-SIM card and the micro-SD card being inserted into the accommodating chamber of the insulating housing, bottoms of the first receiving space and the second receiving space being further opened freely to make the micro-SIM card electrically contact with the contact portions of the signal terminals and the micro-SD card electrically contact with the touching portions of the conductive terminals;

wherein a separating block protrudes upward from a substantial middle of the base board and extends longitudinally to divide the accommodating chamber into a first accommodating chamber with the contact portions projecting therein and a second accommodating chamber with the touching portions projecting therein, the micro-SIM card is located in the first accommodating chamber, the micro-SD card is located in the second accommodating chamber, the supporting tray has a base plate of which two opposite sides bend upward to form two lateral plates, two tops of the two lateral plates extend oppositely to form a first top plate and a second top plate, a plurality of first clamping plates of substantial U-shape from a front view is connected with a free side edge of the first top plate with the mouths thereof facing the corresponding lateral plate at a distance, a free corner at the rear of the first top plate is bent downward, and then bent inward to form a blocking tail, the first receiving space is formed among the first top plate, the corresponding lateral plate, the first clamping plates and the blocking tail, a plurality of second clamping plates of substantial U-shape from the front view is connected with a free side edge of the second top plate with the mouths thereof facing the corresponding lateral plate at a distance, a rear of the free side of the second top plate is cut off to define a gap which has a straight sidewall substantially extending longitudinally, and a tilted sidewall connecting between a front end of the straight sidewall and the free side edge of the second top plate, the tilted sidewall of the gap extends downward and then bends inward to form a blocking plate, two portions of the straight sidewall protrude outward and then bend downward to form two propping arms of which two free ends are connected by a resisting arm therebetween, the second receiving space is formed among the second top plate, the corresponding lateral plate, the second clamping plates, the blocking plate, the propping arms and the resisting arm, and a middle part of the resisting arm is flat arched inward to restrict the micro-SD card in the second receiving space.

2. The card connector as claimed in claim 1, wherein a notch is formed between two of the first clamping plates and located at the rear of the first top plate, and the card connector further includes a limiting element disposed in the first side wall with a resisting portion thereof projecting into the first accommodating chamber to be buckled in the notch.

3. The card connector as claimed in claim 1, further comprising two fastening elements respectively disposed in the first side wall and the second side wall, each fastening element having a pressing plate at a top thereof and a soldering plate at a bottom thereof, the pressing plates projecting into the accommodating chamber to press on the first clamping plates and the second clamping plates, and the soldering plates projecting out of the first side wall and the second side wall, respectively.

4. The card connector as claimed in claim 1, further comprising a first switch terminal having a first base arm, one end of the first base arm being inclined rearward and sideward to form a first fastening arm, a free end of the first fastening arm being bent sideward and then slantwise extending forward to form a first elastic arm away from the first base arm, a free end of the first elastic arm being arched outward to form a first touching arm, a corner between the first side wall and the rear wall defining a first switch terminal groove, and the first switch terminal being disposed in the first switch terminal groove with the first touching arm projecting into the first accommodating chamber to resist against the blocking tail of the supporting tray.

5. The card connector as claimed in claim 1, further comprising a second switch terminal having a second base arm, one end of the second base arm bending forward to form a second elastic arm, a free end of the second elastic arm being arched sideward to form a second touching arm located in front of the second base arm, the insulating housing defining a second switch terminal groove distributed in the second side wall and the rear wall, and the second switch terminal being disposed in the second switch terminal groove with the second touching arm projecting into the second accommodating chamber to resist against the resisting arm of the supporting tray.

* * * * *